United States Patent [19]

Keiichi

[11] 4,126,434

[45] Nov. 21, 1978

[54] ELECTROSTATIC DUST PRECIPITATORS

[76] Inventor: Hara Keiichi, 2-49, Higashi-Mizue, Edogawa-ku, Tokyo, Japan

[21] Appl. No.: 828,941

[22] Filed: Aug. 29, 1977

[30] Foreign Application Priority Data

Sep. 13, 1975 [JP] Japan ..... 50-111184.

Related U.S. Application Data

[63] Continuation of Ser. No. 647,007, Jan. 7, 1976, abandoned.

[51] Int. Cl.[2] ..... B03C 3/00

[52] U.S. Cl. ..... 55/137; 55/151; 55/152; 55/154

[58] Field of Search ..... 55/136–138, 55/150–154

[56] References Cited

U.S. PATENT DOCUMENTS

| | | | |
|---|---|---|---|
| 3,026,964 | 3/1962 | Penney | 55/137 |
| 3,803,808 | 4/1974 | Shibuya et al. | 55/138 |
| 3,853,511 | 12/1974 | Huppi | 55/148 |
| 3,915,672 | 10/1975 | Penney | 55/139 |

FOREIGN PATENT DOCUMENTS

| | | | |
|---|---|---|---|
| 380,917 | 9/1923 | Fed. Rep. of Germany | 55/150 |
| 215,135 | 11/1941 | Switzerland | 55/137 |
| 204,361 | 9/1923 | United Kingdom | 55/138 |

*Primary Examiner*—Bernard Nozick
*Attorney, Agent, or Firm*—Spensley, Horn & Lubitz

[57] ABSTRACT

In an electrostatic dust precipitator of the type including a dust collection electrode structure and a discharge electrode structure which are impressed with DC voltages of the opposite polarities, the discharge electrode structure is constituted by a plurality of rod shaped parallel electrodes having a substantial surface area and discharge members.

7 Claims, 6 Drawing Figures

ELECTROSTATIC DUST PRECIPITATORS

This is a continuation of application Ser. No. 647,007, filed Jan. 7, 1976 now abandoned.

BACKGROUND OF THE INVENTION

The invention relates to electrostatic dust precipitators. Electrostatic dust precipitators have been used in many plants and factories where dust causes polution of the atmosphere, and injuries the health of workmen and where clean environments are required.

FIG. 1 shows one example of the prior art electrostatic dust precipitator comprising a plurality of spaced apart metal rods 1 and a plurality of parallel equally spaced metal wires or discharge electrodes 3 suspending from the metal rods 1. Weights 2 are connected to the lower ends of respective discharge electrodes 3 to maintain them in vertical positions. Dust collection electrodes in the form of flat metal plates 4 are disposed between and outside the arrays of discharge electrodes 3. The weights 2 serve to maintain the distance between the metal wires 3 and the metal plates 4 at a constant value.

In operation, a negative voltage is impressed upon the metal wires 3 and a positive voltage is impressed upon the metal plates 4. Gas or air containing dust is passed between the metal plates 4 in the direction indicated by an arrow. Between the metal wires 3 and the metal plates 4 is created a corona discharge to ionize the gas or air. Most of the particles of the dust are charged negatively and attracted by the positively charged metal plates. However, some of the particles are charged to the opposite polarity so that they are attracted by the metal wires 3. For this reason, after the precipitator has operated for a long period, sufficient amount of corona discharge cannot be produced, thereby decreasing the efficiency of operation. Accordingly, the metal wires are hammered from time to time for removing the dust collected thereon. This not only requires to provide hammers but also causes breakage and short circuiting of the metal wires.

Another example of the prior art electrostatic dust precipitator is shown in FIG. 2 which comprises a plurality of flat plate shaped dust collecting electrodes 41 and a plurality of flat plate shaped discharge electrodes 42 which are interleaved in spaced parallel relationship. A plurality of needles 43 are secured to the inlet side of each discharge electrode 42. The electrostatic dust precipitator shown in FIG. 2 operates in the same manner as that shown in FIG. 1. With this construction, however, the intensity of electric field decreases toward the center of the dust collecting electrodes 41 so that most of the dust is collected on the surface portions of the dust collecting electrodes 41 and on the discharge electrodes 42 near the needles 43 so that even when large electrodes are used, the entire surfaces are not used thus decreasing the efficiency of dust collection. For this reason, in order to treat a large volume of dust containing gas it has been necessary to use a large and expensive electrostatic dust collector.

In the electrostatic dust precipitator of the type referred to above it is essential to maintain constant the electrode spacing. Otherwise, the corona discharge concentrates at some portions or sparks are formed thereby greatly decreasing the efficiency of dust collection. Further, when plate shaped electrodes are used it is difficult to manufacture and install them in perfect parallel positions, that is with uniform spacings. Since large plate shaped electrodes are prepared from rolled metal plates, due to the stress and strains thereof it is difficult to install them perfectly flat. Further, plate shaped electrodes are greatly deformed due to the heat strain created therein during operation. This also decreases the operating efficiency. Flat plate shaped electrodes will be readily deformed by external forces applied thereto at right angles. Thus, when an intense electric field is established between the electrodes they will be deformed greatly.

For the reason described above, it is extremely difficult to maintain uniform distance between the plate shaped electrodes over the entire surfaces thereof so that at present a large error allowance is permitted, thus greatly decreasing the actual dust collecting efficiency than the theoretical value.

SUMMARY OF THE INVENTION

Accordingly, it is an object of this invention to provide an improved electrostatic dust precipitator capable of providing sufficient corona discharge thus asssuring high dust collecting ability over a long period.

Another object of this invention is to provide a novel electrostatic dust precipitator having an improved dust collecting efficiency.

Still another object of this invention is to provide a novel electrostatic dust precipitator capable of reducing its size than the prior art design.

According to this invention there is provided an electrostatic dust precipitator of the type comprising a dust collection electrode structure and a discharge electrode structure opposing the dust collection electrode structure with a definite distance therebetween, and wherein the dust collection electrode structure and the discharge electrode structure are impressed with DC voltages of the opposite polarities, characterized in that the discharge electrode structure comprises a plurality of rod shaped parallel electrodes having a substantial surface area and discharge members.

In one embodiment of this invention, the discharge electrode structure comprises at least one fine metal wire located on the gas inlet side in parallel with other rod shaped discharge electrodes. Some of the intermediate rod shaped discharge electrodes may be replaced by fine metal wires.

In a modified embodiment of this invention, some or all of the rod shaped parallel electrodes are provided with pins having pointed ends and extending in the direction of flow of the dust containing gas.

The dust collection electrode structure comprises a plurality of parallel rod or tube shaped electrodes, or flat plates.

BRIEF DESCRIPTION OF THE DRAWINGS

Further objects and advantages of the invention can be more fully understood from the following detailed description taken in conjunction with the accompanying drawings in which.

DESCRIPTION OF THE PREFERRED EMBODIMENTS

Figure 1:
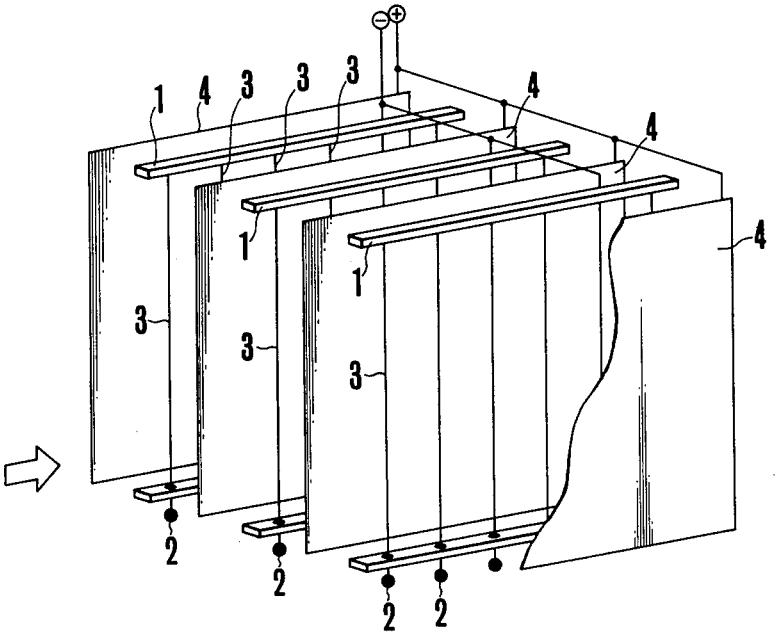
FIG.1 (PRIOR ART)
FIGS. 1 and 2 are diagrammatic perspective views of two examples of the prior art electrostatic dust precipitator.
Figure 2:
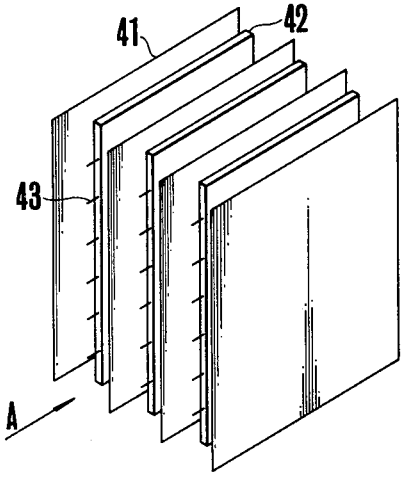
FIG.2 (PRIOR ART)
Figure 3:
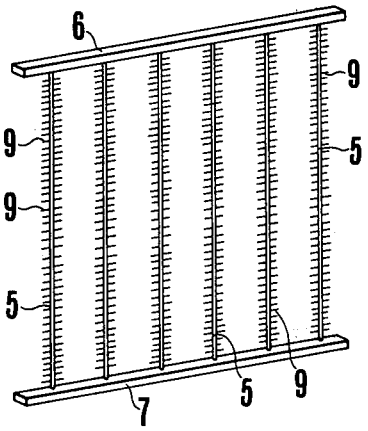
FIG. 3 is a perspective view of a discharge electrode structure embodying the invention.
Figure 4:
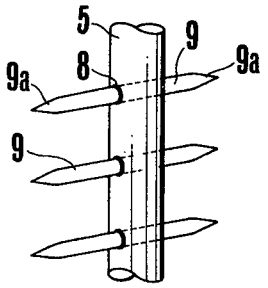
FIG. 4 is an enlarged partial view of a discharge electrode shown in FIG. 3.

As shown in FIGS. 3 and 4, the discharge electrode assembly embodying the invention comprises a plurality of parallel vertical metal rods 5 and a pair of metal bars 6 and 7 respectively supporting the upper and lower ends of the metal rods 5. As shown in FIG. 4, each metal rod 5 is provided with uniformly spaced perforations 8 extending in the direction parallel to the metal bars 6 and 7 and metal pins 9 having pointed ends 9a on the opposite ends are passed through the perforations 8 and secured in position as by calking. The discharge electrode assembly is substituted for the metal wires 3 shown in FIG. 1. It is advantageous to make the diameter of the metal pins 9 to be equal to from 1/100 to 50/100 of the spacing between the metal pins 9 and an adjacent metal plate 4. With pins having a diameter of less than 1/100 of the spacing, they are liable to bend whereas where the diameter is larger than 50/100 of the spacing, the spacing between the metal rod 5 and adjacent plate 4 decreases thus causing frequent spark discharge.

During operation, corona discharges are created between the pointed ends 9a of pins 9 and the flat metal plates 4. At the pointed ends 9a, since vortex phenomena are considerably strong, positively charged dust attracted by the pins 9 are prevented from depositing on the pointed ends 9a by the vortex phenomena but most of the dust is deposited on the main bodies of pins 9 or the side surfaces of the metal rods 5. Since these portions (other than the pointed ends) do not contribute to the corona discharge, deposition of dust thereon does not affect the efficiency of dust collection. For this reason, even when the dust precipitator is operated over a long period, it is possible to create sufficiently large corona discharge and assure high operating efficiencies.

When the pins 9 are secured to the metal rods 5 by calking as described above, it is possible to secure the pins 9 more readily than other methods such as welding and soldering. Further, it is possible for calking to prevent oxydation and bending of the metal rods 5 which would be caused by the heat used to secure the pins 9.

If desired, discharge electrodes of other configuration may be added to the illustrated discharge electrodes. Further, it will be clear that instead of using circular rods 5 the electrodes may be made of hollow tubes, or rods of polygonal cross section, although circular rods or tubes are preferred.

Figure 5:
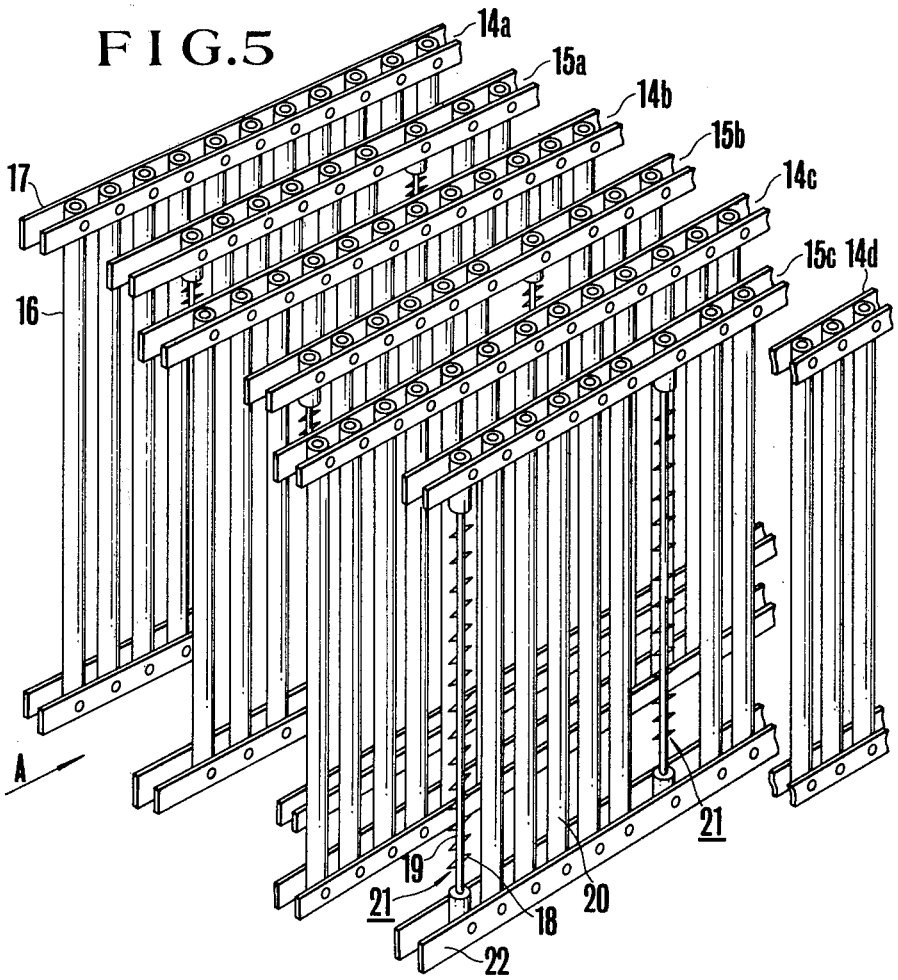
FIGS. 5 and 6 are perspective views showing other embodiments of this invention.

A modified embodiment of this invention shown in FIG. 5, comprises a plurality of dust collection electrodes 14a–14d and a plurality of discharge electrodes 15a–15d which are interleaved in spaced parallel relationship. Each of the dust collection electrodes comprises a plurality of hollow metal tubes 16 arranged in parallel in the vertical direction, and supporting frames 17 extending in the direction of flow of the dust containing gas for supporting the upper and lower ends of the tubes 16. One block of the discharge structure comprises discharge members 21, a plurality of (5 in this example) metal tubes or rods 20 located between adjacent discharge members 21, and supporting frames 22 extending in the direction of the flow of the dust containing gas indicated by arrow A. Each discharge member 21 has the same construction as that shown in FIGS. 3 and 4, that is it comprises a plurality of pins 18 secured to a metal rod 19.

In operation, high direct current voltage having a polarity to make positive the dust collecting electrodes 14a–14d is impressed across the dust collecting electrodes 14a–14d and the discharge electrodes 15a–15d. Then, corona discharges are created between the pointed ends of the pins 18 and the dust collecting electrodes 14a–14d thereby ionizing the gas passing therebetween. The particles of the dust are charged with negative ions and deposit on the metal rods 16 comprising the dust collection electrodes, whereas positively charged dust particles deposit on the surfaces of nearby metal tubes 20. Dust particles not collected by the early stage will be collected by the succeeding stages.

Since the dust collection electrodes 14a–14d and discharge electrodes 15a–15c comprise an assembly of spaced parallel metal rods or tubes 16 and 20, the effective dust collecting areas of these electrodes are increased greatly. In one dust precipitator having a stay distance of 2.02m which is equal to the length of the dust collection electrodes, the total distance of the dust collection electrodes is equal to the sum of the lengths of both surfaces of the dust collection electrodes which is equal to twice of the stay distance. The total distance of the discharge electrodes is equal to the sum of the lengths of both surfaces of the discharge electrodes. According to a prior art design, having a stay distance of 2.02m, the total distance between the dust collection electrodes is equal to 4.04m, and the total distance between the discharge electrodes is equal to 1.15m, giving a sum of 5.19m. In the dust precipitator in which 57 metal rods having a diameter of 25 mm are disposed in parallel at a spacing of 10 mm the total distance of 57 dust collection electrodes is $0.025(m) \times 3.14 \times 57 + 0.010 \times 56 = 5.04(m)$ and the total distance of 25 discharge electrodes is equal to 2.16m giving a total of 7.2m which is larger by 2.01m (about 40%) than that of the prior art design.

When dust particles successively deposit on the metal rods, the spaces between the metal rods will finally be filled by the dust particles having the same potential. Thus, the spaces between the metal rods act as effective dust collecting surfaces. Since dust collection electrodes and the discharge electrodes have round surface, it is difficult for the electric discharge to occur between the electrodes. For this reason, it is possible to decrease the distance between the dust collection and discharge electrodes thus creating intense electric field therebetween. Further, as metal tubes or rods can resist against external forces applied thereto in the perpendicular direction, they resist against deformation caused by intense electric field thus maintaining constant the distance between the dust collection electrodes and the discharge electrodes. Further, since such metal rods or tubes are manufactured by extrusion they do not contain any strain so that it is possible to prevent any deformation from being formed at the time of installation or caused by heating, thus maintaining uniform distance between electrodes.

Since the dust precipitator can be readily assembled by merely mounting the metal rods or tubes on the supporting frames, it is not necessary to carefully handle plate electrodes not to bend as in the prior art design thus greatly facilitating the manufacture and assembly and reducing the cost of the electrostatic dust precipitator.

It will be clear that one of discharge members 21 provided with pins 18 may be provided at the inlet end of the dust containing gas.

Figure 6:
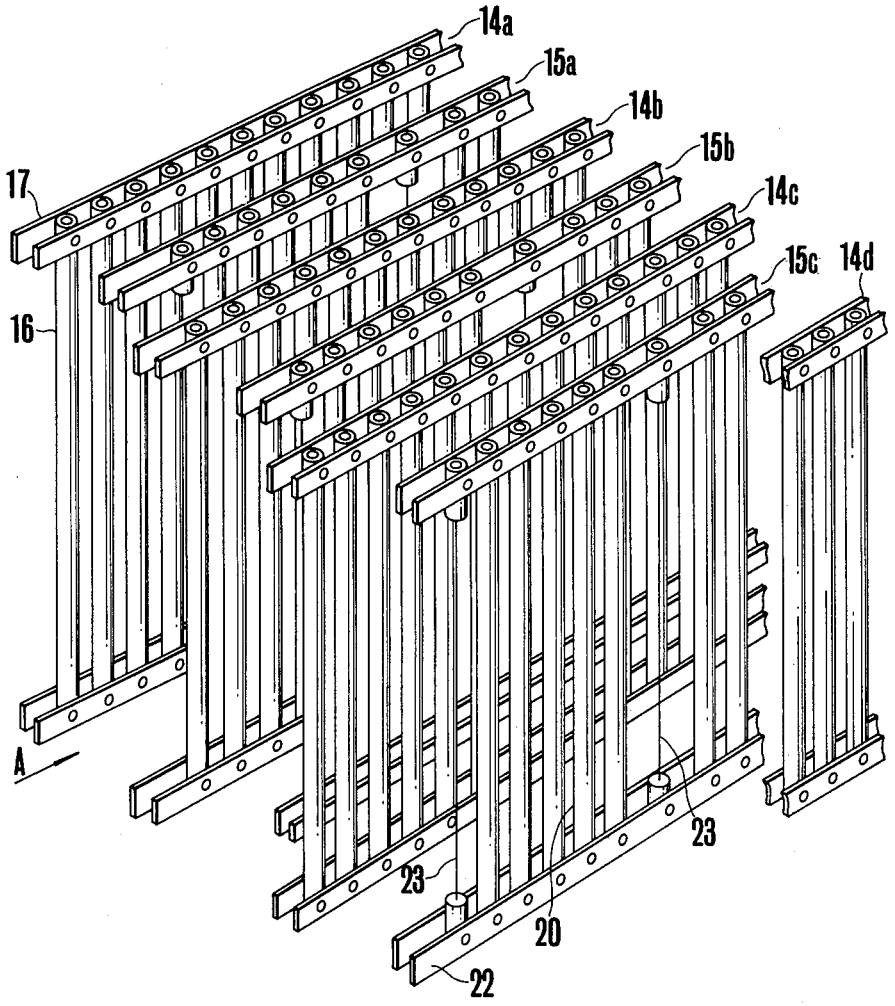

The embodiment shown in FIG. 6 is identical to that shown in FIG. 5 except that discharge members 21 are substituted by fine metal wires 23 which act in the same manner as pointed pins 18 to produce corona discharge.

It is possible to arrange the electrodes more densely then those illustrated in the drawing.

What is claimed is:

1. An electrostatic dust precipitator comprising:

a discharge electrode structure comprising:

a plurality of rod-shaped parallel electrodes of circular cross-section; and a plurality of pins provided on a predetermined number of less than all of said rod-shaped electrodes and extending in a direction of the flow of a dust containing gas in said electrostatic dust precipitator wherein the rod shaped electrode with pins is upstream of the rod shaped electrode without pins;

a dust collection electrode structure, said dust collection electrode structure comprising a plurality of spaced apart rod-shaped parallel electrodes of circular cross-section;

means for supporting said discharge electrode structure and said dust collection electrode structure in spaced parallel opposing relationship; and means for supplying DC voltages of opposite polarities upon said discharge electrode structure and said dust collection electrode structure whereby the dust containing gas initially flows between a rod shaped discharge electrode with pins and a rod shaped collecting electrode.

2. The electrostatic dust precipitator according to claim 1 wherein said discharge electrode structure comprises the plurality of rod shaped parallel electrodes of circular cross-section.

3. The electrostatic dust precipitator according to claim 2 wherein a predetermined number of said rod shaped electrodes are provided with a plurality of pins having pointed opposite ends and extending in the direction of the flow of dust containing gas, said rod shaped electrodes and rod shaped electrodes provided with pins being spaced by a predetermined number of rod shaped electrodes.

4. The electrostatic dust precipitator according to claim 1 wherein said dust collection electrode structure comprises a plurality of parallel rod shaped electrodes.

5. An electrostatic dust precipitator according to claim 1 wherein said discharge electrode structure and said dust collection electrode structure are parallel to the flow of the dust containing gas through said electrostatic dust precipitator.

6. An electrostatic dust precipitator according to claim 5 wherein the predetermined number of rod-shaped electrodes provided with a plurality of pins comprises one rod-shaped electrode with pins for every five rod-shaped electrodes without pins.

7. A multi-stage electrostatic dust precipitator comprising:

a discharge electrode structure aligned in a direction of the flow of a dust containing gas and comprising a plurality of blocks each of which includes a single rod-shaped electrode, disposed at the entrance of the block, with a plurality of pins extending in said direction of the dust containing gas flow and a predetermined number of spaced apart rod-shaped parallel electrodes without the pins disposed between the single rod-shaped electrode with the pins of one block and that of an adjacent block to prevent interactions between pins provided for the one block and those for an adjacent block, said rod-shaped electrode without the pins having a large longitudinal surface area to promote the attraction thereto of positively charged dust particles;

a dust collection electrode structure comprising a plurality of spaced apart rod-shaped parallel electrodes of substantially the same configuration as that of said electrode without the pins;

means for supporting said discharge electrode structure and said dust collection electrode structure in spaced parallel opposing relationship, wherein a distance between the pin and one rod-shaped electrode opposing thereto of the dust collection electrode structure is different from a distance between the rod-shaped electrode of the dust collection electrode structure and the opposing rod-shaped electrode without the pins of the discharge electrode structure;

means for supplying DC voltages of opposite polarities upon said discharge electrode structure and said dust collection electrode structure; and means, including said single electrode with the pins, said one rod-shaped electrode opposing thereto of the dust collection electrode structure and one rod-shaped electrode without the pins adjacent to said single electrode within the same block, for forming, when applied with the DC voltages of opposite polarities, a steeply localized and highly intensive ionization region between said pin and said one rod-shaped electrode of the dust collection electrode structure.

* * * * *